United States Patent [19]

Fetters

[11] Patent Number: 4,692,953

[45] Date of Patent: Sep. 15, 1987

[54] PORTABLE COLLAPSIBLE BABY CRIB

[76] Inventor: G. David Fetters, 247 Schilling St., West Lafayette, Ind. 47906

[21] Appl. No.: 884,487

[22] Filed: Jul. 11, 1986

[51] Int. Cl.[4] ..... A47C 29/00

[52] U.S. Cl. ..... 5/99 R; 5/99 A

[58] Field of Search ..... 5/93 R, 94, 98 R, 99 R, 5/99 A, 110, 111

[56] References Cited

U.S. PATENT DOCUMENTS 2,691,177 10/1954 Leonard ..... 5/98 R
2,846,699 8/1958 Watson ..... 5/98 R

FOREIGN PATENT DOCUMENTS 1247111 10/1960 France ..... 5/99 R

*Primary Examiner*—Gary L. Smith
*Assistant Examiner*—Michael F. Trettel
*Attorney, Agent, or Firm*—Woodard, Emhardt, Naughton, Moriarty & McNett

[57] ABSTRACT

A portable collapsible crib, comprising a rigid frame that is separable at the midpoints of a pair of opposing sides, rotatable hinging means coupling the frame halves at said midpoints, hingingly operable about first axes for foldably collapsing the frame halves one upon the other at the midpoints, and rotatably operable about a pair of second axes that are perpendicular to the first axes for rigidly supporting the frame halves in inflexible planar alignment. Leg means are provided, mounted to and rotatable about the frame concurrently with the rotatable hinging means being further rotatable about the frame and into the area bounded by the frame, with the rotatable hinging means being concurrently rotated into the frame collapsing position. A collapsible crib element is mounted to and supported about the perimeter of the frame and is disposed downwardly therefrom, having rigid floor means and operable to receive the solid frame and the leg means within the area bounded by the perimeter of the floor means and being further operable to fold about and completely enclose the frame halves when in the frame collapsing position, forming a valise structure thereabout.

12 Claims, 8 Drawing Figures

PORTABLE COLLAPSIBLE BABY CRIB

BACKGROUND OF THE INVENTION

Many patents have issued that disclose baby cribs with various mechanisms to provide parents the convenience of crib mobility. Disclosed herein is a novel portable collapsible baby crib that utilizes a more useful and efficient collapsible support structure to support a collapsible crib structure than has heretofore been known in the prior art. The disclosed invention permits the parent to collapse the baby's crib into a compact valise structure that is readily portable when the parents need to travel with their infant.

SUMMARY OF THE INVENTION

One embodiment of the present invention is a portable collapsible crib, comprising a rigid frame that is separable at the midpoints of a pair of opposing sides thereof into a first frame half and a second frame half, rotatable hinging means, coupling the first and second frame halves at said midpoints, hingingly operable about first axes for foldably collapsing the first and second frame halves one upon the other at the midpoints, and defining a frame collapsing position, and rotatably operable about a pair of second axes that are perpendicular to the first axes for rigidly supporting the first and second frame halves in inflexible planar alignment, and defining a frame inflexible position; leg means, mounted to and rotatable about the frame concurrently with the rotatable hinging means, for elevating the frame to a predetermined height when rotated about and disposed downwardly from the frame, the rotatable hinging means being concurrently rotated into the frame inflexible position, the leg means being further rotatable about the frame into the area bounded by the frame, the rotatable hinging means being concurrently rotated into the frame collapsing position; and a collapsible crib element mounted to and supported about the perimeter of the frame and disposed downwardly therefrom, having rigid floor means removably attached to the leg means at predetermined points below the solid frame when the leg means are rotated about and disposed downwardly from the frame and operable to receive the solid frame and the leg means and the collapsible crib structure within the area bounded by the perimeter of the floor means when the leg means are rotated about the frame into the area bounded by the frame, the rotatable hinge means being concurrently rotated into the frame collapsing position; the rigid floor means being further operable to fold about and enclose the first and second frame halves when in the frame collapsing position, forming a valise structure thereabout.

Another embodiment of the present invention is a portable collapsible frame for supporting a collapsible crib structure, comprising a rigid frame that is separable at the midpoints of a pair of opposing sides thereof into a first frame half and a second frame half; rotatable hinging means, coupling the first and second frame halves at the midpoints, hingingly operable about first axes for foldably collapsing the first and second frame halves one upon the other at the midpoints, and defining a frame collapsing position, and rotatably operable about a pair of second axes that are perpendicular to the first axes for rigidly supporting the first and second frame halves in inflexible planar alignment, and defining a frame inflexible position; leg means, mounted to and rotatable about the frame concurrently with the rotatable hinging means, for elevating the frame to a predetermined height when rotated about and disposed downwardly from the frame, the rotatable hinging means being concurrently rotated into the frame inflexible position, the leg means being further rotatable about the frame into the area bounded by the frame, the rotatable hinging means being concurrently rotated into the frame collapsing position; and rigid floor means removably attached to the leg means at predetermined points below the solid frame when the leg means are rotated about and disposed downwardly from the frame, and operable to receive the solid frame and the leg means within the area bounded by the perimeter of the floor means when the leg means are rotated about the frame into the area bounded by the frame, the rotatable hinge means being concurrently rotated into the frame collapsing position; the rigid floor means being further operable to foldably collapse about and enclose the first and second frame halves in the frame collapsing position, forming a valise structure.

It is an object of the present invention to provide a novel portable collapsible baby crib that utilizes a completely new and a more useful and efficient collapsible support structure than has heretofore been known in the prior art.

It is a further object of the present invention to provide a collapsible baby crib that collapses into a compact valise structure that serves as the elevated floor of the baby crib when the baby crib is in use.

It is a further object of the present invention to provide a portable collapsible crib with novel rotatable hinging means integrally mounted to the baby crib support structure and that rotate with the collapsible legs of the support structure, providing rigid support for the support structure when the legs are in use and providing collapsibility to the support structure when the legs are rotated into a collapsed position.

Related objects and advantages of the present invention will be apparent from the following description.

DESCRIPTION OF THE PREFERRED EMBODIMENT

Figure 1:
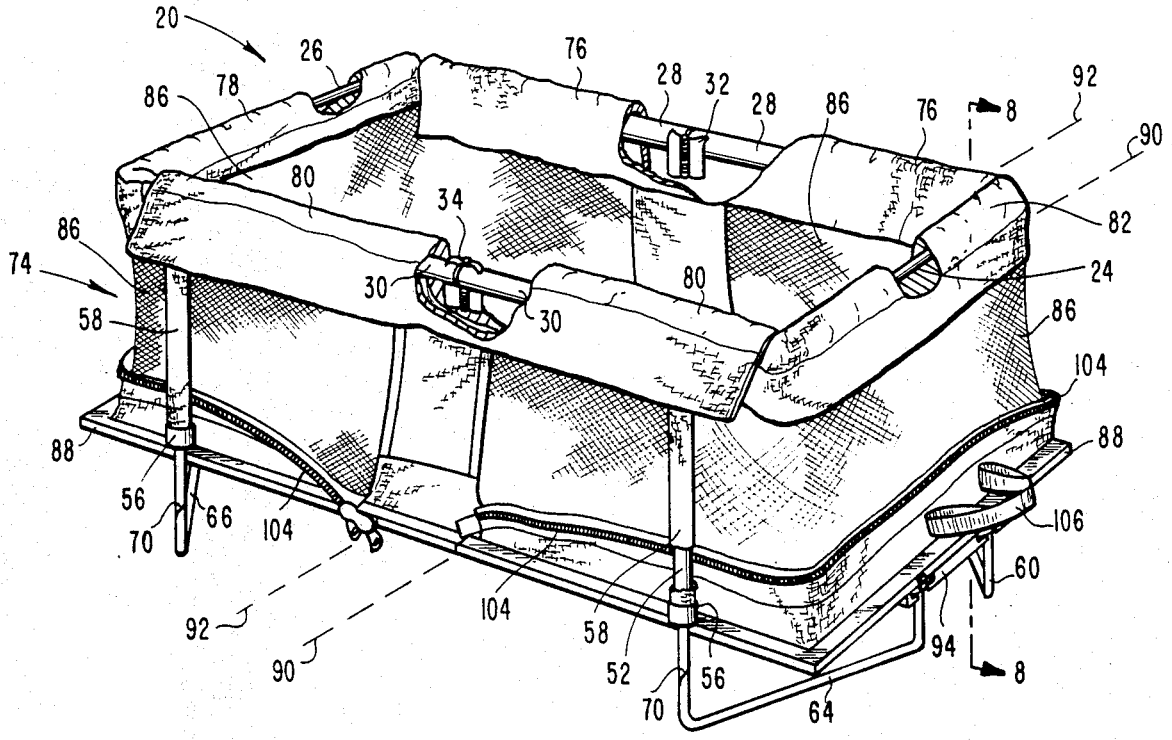
FIG. 1 is a perspective and partially segmented view of the preferred embodiment of the portable collapsible baby crib of the present invention uncollapsed and ready for use with the rotatable hinging means of the present invention in the frame inflexible position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
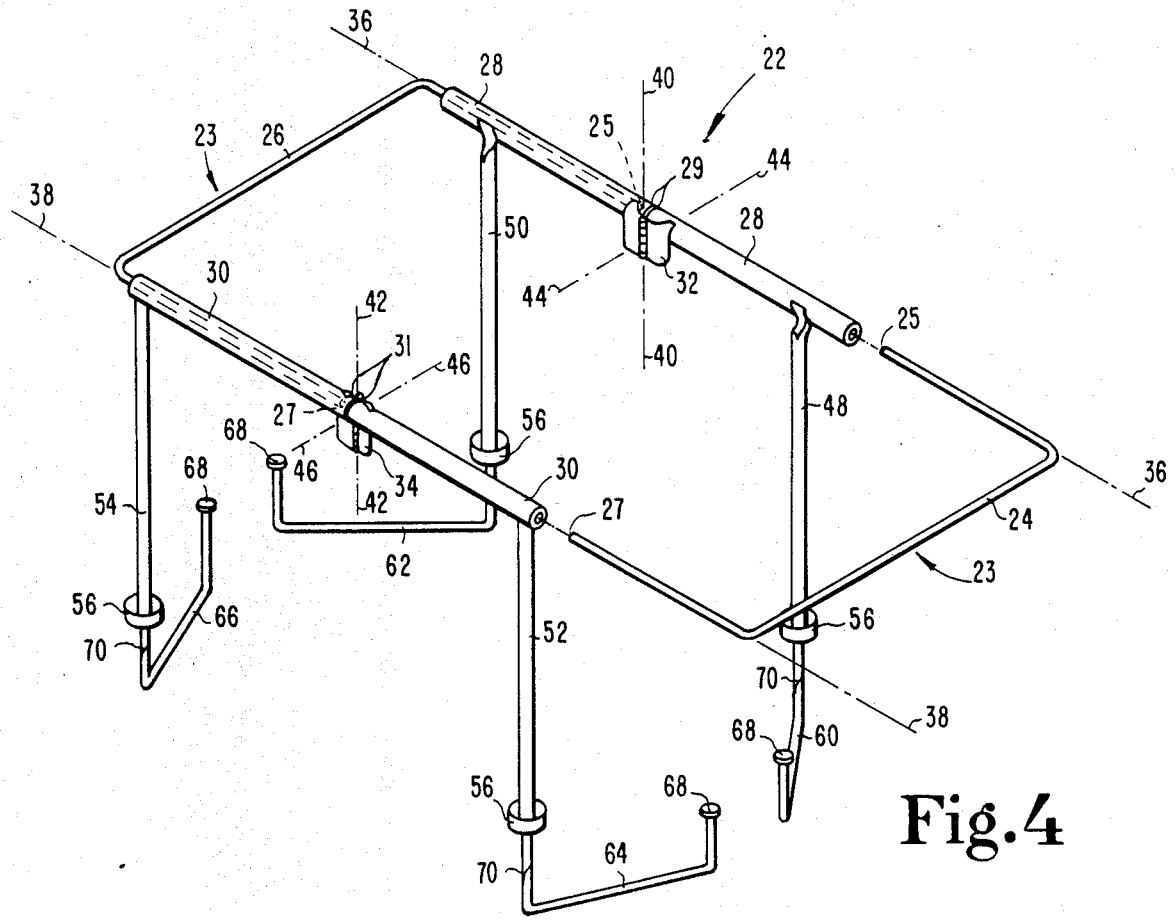
FIG. 4 is a perspective and partially exploded view of the support structure of the portable collapsible baby crib of FIG. 1, shown without the collapsible crib structure of the present invention, and uncollapsed and ready for use with the rotatable hinging means of the present invention in the frame inflexible position.

Referring now to the drawings, there is shown in FIG. 1 the preferred embodiment of the portable collapsible baby crib 20 of the present invention, shown in FIG. 1 uncollapsed and ready for use. Referring to FIGS. 1 and 4, the portable collapsible baby crib 20 has an underlying support structure 22. Support structure 22 includes a rigid frame 23 that is separable at the midpoints 25 and 27 of a pair of opposing sides thereof into a first frame half 24 and a second frame half 26. In the preferred embodiment, first and second frame halves 24 and 26 are identically sized cylindrical U-tubes, constructed of readily available cylindrical tube stock, which, when midpoints 25 and 27 are placed end-to-end form a rectangularly-shaped rigid frame separable at the midpoints 25 and 27 of the pair of longest opposing sides thereof.

Continuing to refer to FIG. 4, the rotatable hinging means of the preferred embodiment includes a rigid first top rail tube 28 and a rigid second top rail tube 30 each separably hinged at midpoint 29 and 31, respectively, thereof by first hinge 32 and second hinge 34, respectively, said hinges being conventional in design. First and second hinges 32 and 34 are fixedly attached to first and second top rail tubes 28 and 30 at midpoints 29 and 31, respectively, by conventional means, such as by welding of the flanges of hinges 32 and 34 to top rail tubes 28 and 30 across midpoints 29 and 31, respectively.

Top rail tubes 28 and 30 are sized and disposed in parallel relationship such that they slidably receive first frame half 24 at corresponding ends of first and second top rail tubes 28 and 30, and slidably receive second frame half 26 at corresponding opposite ends of first and second top rail tubes 28 and 30, thereby couplingly aligning first and second frame halves 24 and 26 together at midpoints 25 and 27. Top rail tubes 28 and 30 remain rotatable about the received portions of first and second frame halves 24 and 26, and thus rotatable top rail tubes 28 and 30 are operable to rotate said first and second hinges 32 and 34 about a pair of second axes of rotation that are along lines 36—36 and 38—38, respectively, in FIG. 4, which are the axes of rotation of top rail tubes 28 and 30, respectively.

As oriented in FIG. 4, first and second hinges 32 and 34 are hingingly operable only about the axes that are along lines 40—40 and 42—42, respectively. Although first and second top rail tubes 28 and 30 are separable at midpoints 29 and 31, now bounded by first and second hinges 32 and 34, when first and second top rail tubes 28 and 30 receive first and second frame halves 24 and 26 in the manner described above, top rail tubes 28 and 30 are rigidly held end to end through the lack of hinging action of first and second hinges 32 and 34 about the axes along lines 44—44 and 46—46, and resistance to hinging about the axes along lines 40—40 and 42—42 due to the rigidity provided by first and second frame halves 24 and 26. Because first and second hinges 32 and 34 are not hingingly operable about the axes which are lines 44—44 and 46—46 when oriented as shown in FIG. 4, first and second hinges 32 and 34 are operable to provide structural rigidity about these axes, holding first and second frame halves in inflexible planar alignment, and defining in that orientation the frame inflexible position.

Continuing to refer to FIG. 4, the leg means of the preferred embodiment include a first pair of legs 48 and 50 attached to first top rail tube 28 near opposite ends of top rail tube 28 and disposed downwardly therefrom on either side of first hinge 32 when first hinge 32 is oriented in the frame inflexible position. Also included is a second pair of legs 52 and 54 attached to second top rail tube 30 at opposite ends of top rail tube 30 and disposed downwardly therefrom on either side of second hinge 34 when second hinge 34 is oriented into the frame inflexible position. Legs 48, 50, 52, and 54 of the preferred embodiment are constructed from conventional tubing appropriately crimped at the proximate ends thereof to accommodate attachment by conventional means to top rail tubing 28 and 30, such as by welding legs 48, 50, 52 and 54 at their respective proximal ends to their respective top rail tubes 28 and 30.

Figure 8:
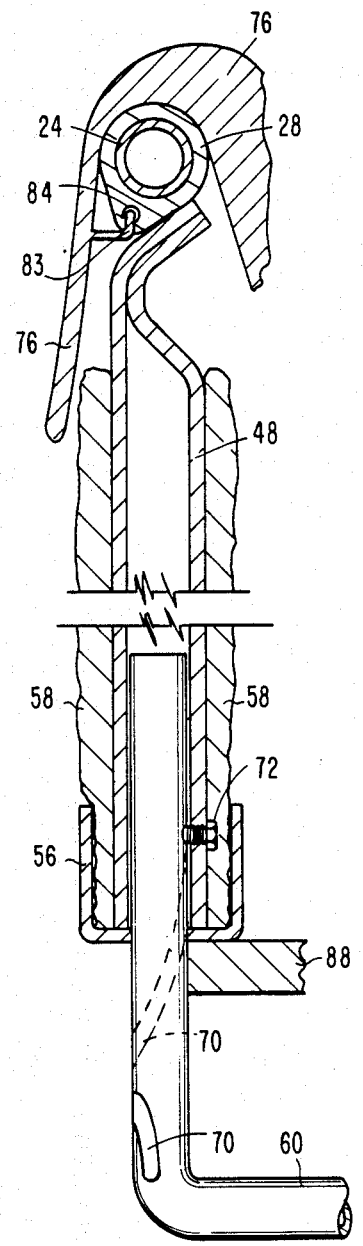
FIG. 8 is an enlarged partially segmented view taken along line 8—8 of FIG. 1 and viewed in the direction of the arrows.

Referring to FIGS. 4 and 8, the distal ends of legs 48, 50, 52 and 54 are provided with identically sized caps 56, each sized to receive one such leg (leg 48 in FIG. 4) and padding 58 provided to surround each leg 48, 50, 52 and 54 in the preferred embodiment (shown in FIG. 8, not shown in FIG. 4). The leg means of the preferred embodiment further include a first pair of bottom support means 60 and 62 and a second pair of bottom support means 64 and 66 each pivotally received at the distal ends of legs 48, 50, 52, and 54, respectively, through caps 56 (see FIG. 8). Bottom support means 60, 62, 64, and 66 of the preferred embodiment are constructed of conventional tubing of an appropriate outside diameter to be snugly received in the distal ends of legs 48 (FIG. 8), 50, 52, and 54. In the preferred embodiment, bottom support means 60, 62, 64, and 66 are U-shaped, with one end of each such support means received into legs 60 (FIG. 8), 62, 64, and 66 and the other end capped with buttons 68 (FIG. 4).

Referring to FIG. 8, each bottom support means 60, 62 (FIG. 8), 64, and 66 is provided with a spiral groove 70 (FIG. 8) at the end received into legs 48 (FIG. 8), 50, 52, and 54, which spiral groove 70 receives groove screw 72 (FIG. 8) within the distal end of legs 48, 50 (FIG. 8), 52 and 54. Groove screw 72 (FIG. 8) is securely fastened through legs 48 (FIG. 8), 50, 52, and 54 with distal end thereof protruding through legs 48 (FIG. 8), 50, 52, and 54, said distal end being received into spiral groove 70 (FIG. 8). Groove screw 72 guides bottom support means 60 (FIG. 8), 62, 64, and 66 into correct position relative to legs 48 (FIG. 8), 50, 52, and 54, groove screw 72 (FIG. 8) tracking within the spiral groove 70 (FIG. 8) as bottom support means 60 (FIG. 8), 62, 64, and 66 are rotated between the frame inflexible position, shown in FIG. 4, and the frame collapsible position, to be described below.

Figure 2:
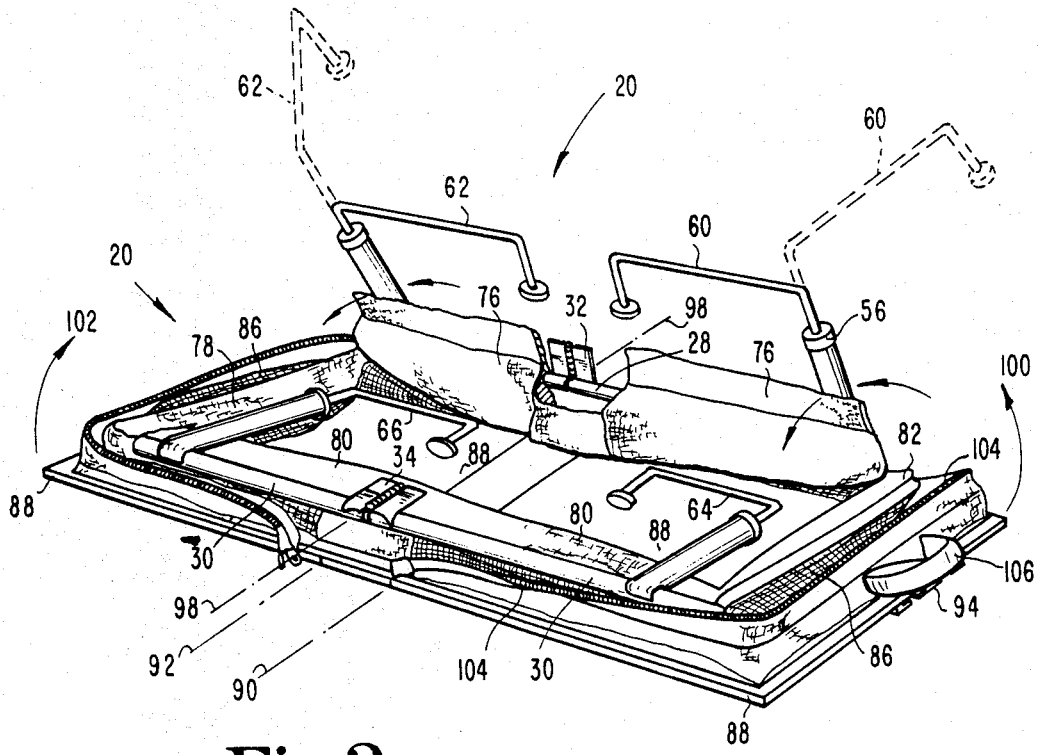
FIG. 2 is a perspective and partially segmented view of the portable collapsible baby crib of FIG. 1 with the crib structure fully collapsed and the support structure partially collapsed.

Referring now to FIGS. 1, 2, 4 and 7, support structure 22 (FIG. 4) supports a collapsible crib structure 74 shown in FIG. 1 mounted to and supported about the perimeter of first and second frame halves 24 and 26, including first and second top rail tubes 28 and 30. As shown in FIG. 1, first and second frame halves 24 and 26 are completely surrounded by padding 82 and 78 at the midportions thereof, and first and second top rail tubes 28 and 30 are substantially surrounded by padding 76 and 80, which padding can be conventional cloth covered foam padding. Padding 76 substantially surrounding first top rail tube 28 and first hinge 32, is separable from padding 78 and 82, and in like manner padding 80 is separable from padding 78 and 82. Referring to FIGS. 1 and 8, padding 76 and 80 substantially surrounds first and second hinges 32 and 34, extending freely over the upper-most surfaces of first and second top rail tubes 28 and 30, and extending downwardly over the outward-most and inner-most surfaces of first and second top rail tubes 28 and 30 until it overlaps padding 58. Referring to FIG. 8, top rail tubes 28 (FIG. 8) and 30 are each provided with identical channels 84 (shown in FIG. 8 on top rail tube 28) into which tabs (83 in FIG. 8) on padding 76 and 80 are secured in conventional tongue and groove relationship. So attached, padding 76 and 80 (FIG. 6) are rotatable about first and second frame halves 24 and 26 with first and second top rail tubes 28 and 30, as will be described below, rotating padding 76 and 80 into the area bounded by first and second frame halves 24 and 26 and thereby rendering first and second hinges 32 and 34 free of padding 76 and 80 (FIG. 2). Padding 76 and 80 will therefore substantially surround top rail tubes 28 and 30 and first and second hinges 32 and 34 when in the frame inflexible position, but will rotatingly unwrap about first and second top rail tubes 28 and 30 into a position that will not inhibit a full collapsing of the first and second hinges 32 and 34 about the axis that is line 98-98 (FIGS. 2 and 5) when in the frame collapsible position.

Figure 7:
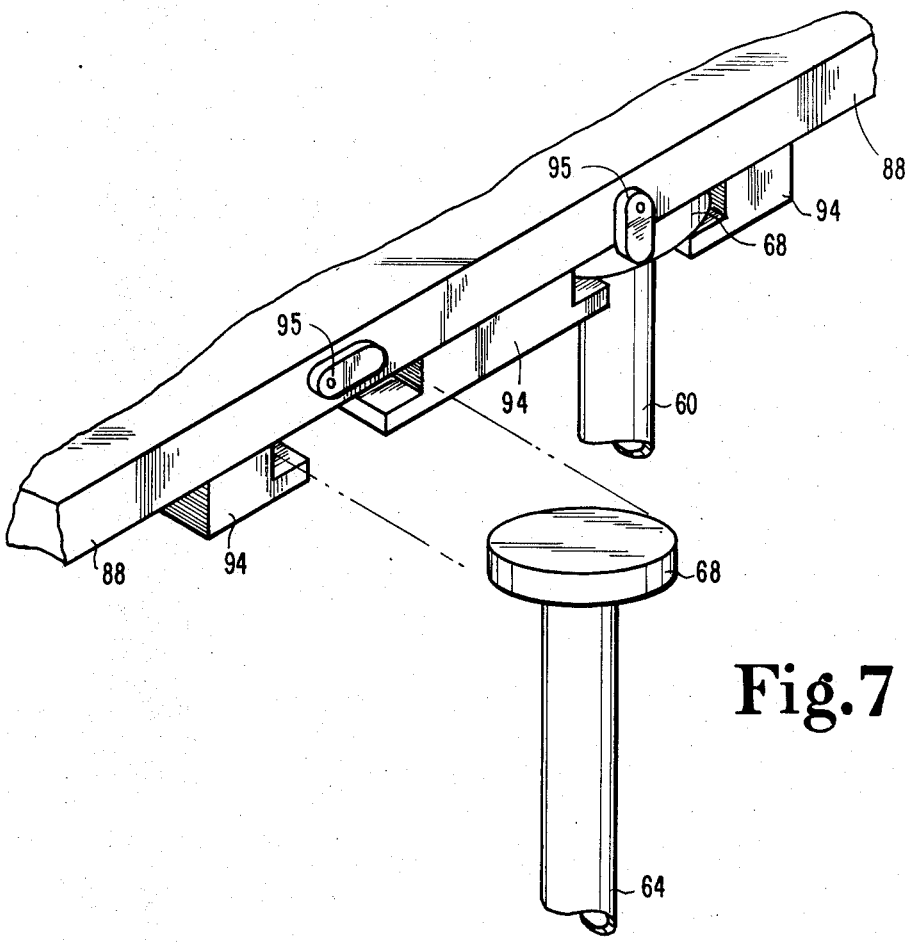
FIG. 7 is an enlarged perspective and segmented end view of the portable collapsible baby crib of FIG. 1

The collapsible crib structure of the preferred embodiment further includes conventional webbed wall structure 86 appended from the bottom-most edges of padding 76, 78, 80, and 82, joining said padding together around the bottom-most edges thereof. Webbed wall structure 86 is in turn attached to the rigid floor means of the present invention. Referring to FIGS. 1, 7 and 8, the rigid floor means of the present invention includes a rigid floor member 88 hinged along lines 90—90 and 92—92. Rigid floor member 88 is suspendingly attached about its perimeter to webbed wall structure 86. Such attachment can be accomplished by any number of conventional means utilized to attach fabric-like structure to a rigid surface. When support structure 22 is in the frame inflexible position (FIG. 1), rigid floor member 88 is lockingly secured under caps 56 (see FIGS. 1 and 8) by the upward tensional forces of the taut webbed wall structure 86, thereby holding rigid floor member 88 tightly against caps 56 as shown in FIG. 8. Similarly, first and second frame halves 24 and 26 can be held within first and second top rail tubes 28 and 30 by the tensional forces of the taut webbed wall structure 86 when positioned in the manner described above.

Figure 3:
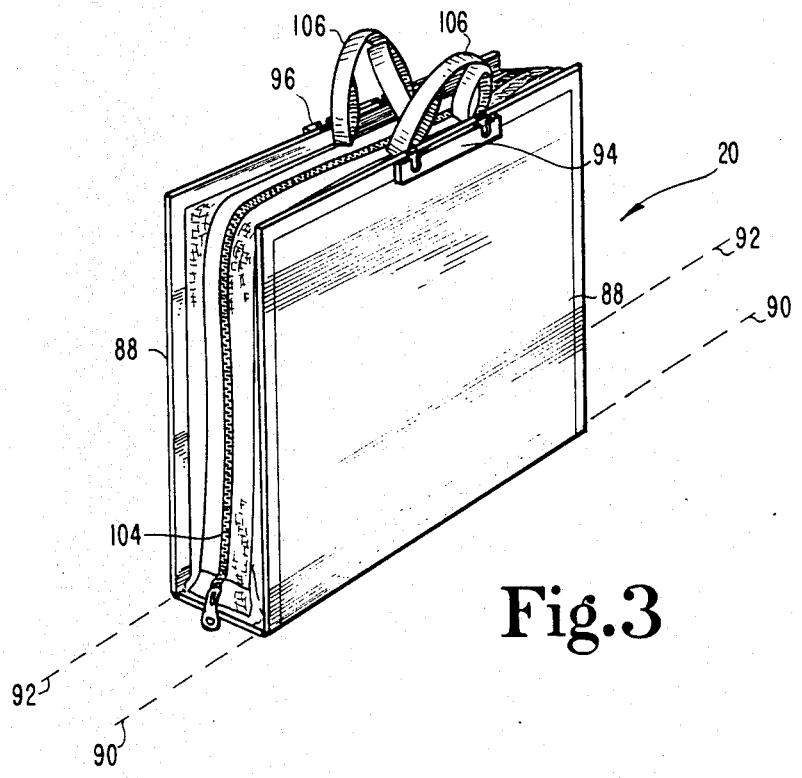
FIG. 3 is a perspective view of the portable collapsible baby crib of FIG. 1 with the valise structure fully closed.

Referring to FIGS. 3 and 7, rigid floor member 88 is provided with identical locks 94 (FIG. 7) and 96 (FIG. 3) to lockingly receive buttons 68 of bottom supports 60 and 64, and 62 and 66, respectively, when support structure 22 is in the frame inflexible position (FIG. 4), thereby providing further rigidity to the support structure 22. Finger snaps 95 snappingly arrest buttons 68 within locks 94 and 96 when support structure 22 is in the frame inflexible position.

Figure 6:
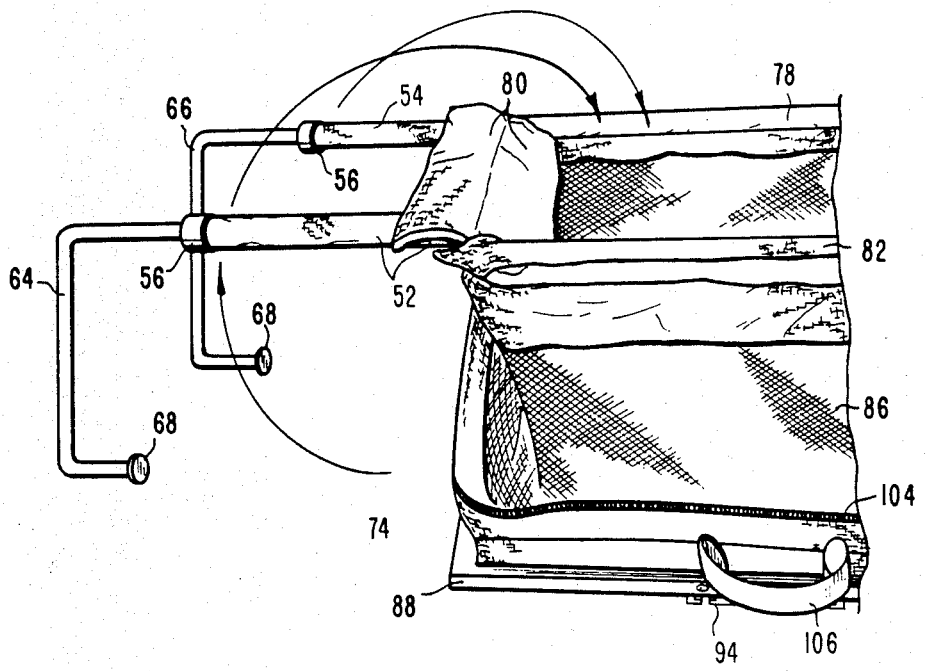
FIG. 6 is a perspective and partial end view of the portable collapsible baby crib of FIG. 1 with the leg means of the preferred embodiment rotated about the frame of the present invention.

Referring to FIG. 6, when buttons 68 are slidably removed from the locking engagement of button locks 94 and 96, legs 52 and 54 and the appended bottom supports 64 and 66 (FIG. 4) are rotatable with top rail tube 30, second hinge 34 (FIG. 4) and the appended padding 80 (FIG. 1) outwardly and away from rigid member 88 and through approximately 270° until legs 52 and 54 are received within the area bounded by first and second frame halves 24 and 26 (FIG. 2). Simultaneously, bottom supports 64 and 66 are pivotal within legs 52 and 54 along spiral groove 70 (FIG. 8), whereby bottom supports 64 and 66 are partially received within legs 52 and 54 and the remaining portions of bottom supports 64 and 66 are pivoted into the area bounded by first and second frame halves 24 and 26 and into planar relationship therewith (FIG. 2). In mirrored-image relationship, legs 48 and 50 and the appended bottom supports 60 and 62 (FIG. 4) are rotatable with top rail tube 28, first hinge 32 (FIG. 4) and the appended padding 76 outwardly and away from rigid member 88 and through approximately 270° until legs 48 and 50 are received within the area bounded by first and second frame halves 24 and 26 (FIG. 2). Simultaneously, bottom supports 60 and 62 are pivotal within legs 48 and 50 along spiral groove 70 (FIG. 8), whereby bottom supports 60 and 62 are partially received within legs 48 and 50 and the remaining portions of bottom supports 60 and 62 are pivoted into the area bounded by first and second frame halves 24 and 26 and into planar relationship therewith (FIG. 2). Such configuration defines the frame collapsible position. Legs 48 and 50 and legs 52 and 54 are located along first and second top rails 28 and 30, respectively, such that when legs 48 and 50 and 52 and 54 are rotated into the area bounded by first and second frame halves 24 and 26, legs 48 and 52, and 50 and 54 are in side-by-side relationship, and not stacked.

When the legs 48, 50, 52, and 54 and bottom supports 60, 62, 64, and 66 are so rotated, first and second frame halves 24 and 26 and first and second top rail halves 28 and 30 are simultaneously collapsed downwardly into rigid bottom member 88, carrying therewith the webbed wall structure 86, all of which is collapsed within the area bounded by the perimeter of the rigid bottom member 88 (FIG. 2).

Figure 5:
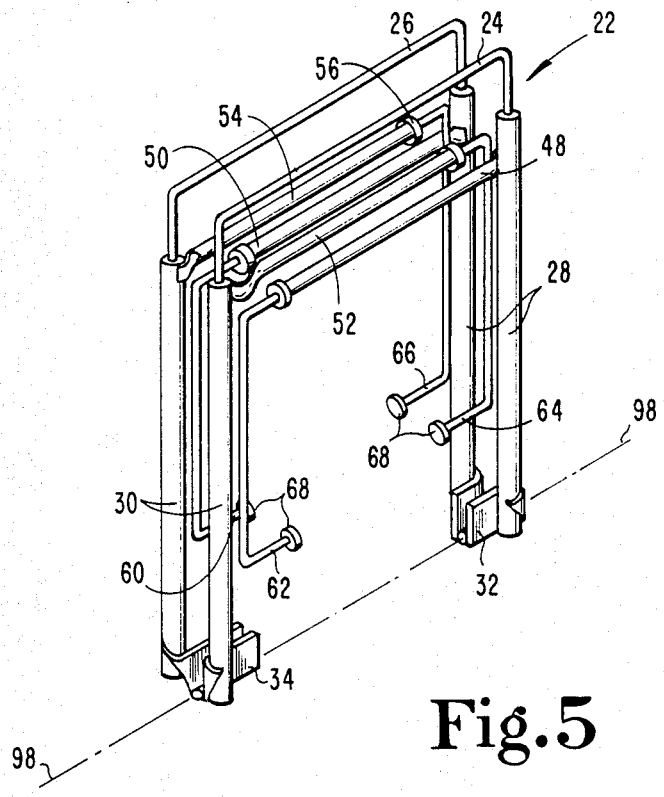
FIG. 5 is a perspective view of the support structure of the portable collapsible baby crib of FIG. 1, shown without the collapsible crib structure of the present invention, fully collapsed with the rotatable hinging means of the present invention in the frame collapsing position.

Referring to FIG. 2, when first and second hinges 32 and 34 are rotated as described above, first and second hinges 32 and 34 are oriented and disposed atop first and second top rails 28 and 30 respectively such that first and second hinges become hingingly operable about the axis that is line 98—98. In such orientation, rigid floor member 88 is hingingly operable along lines 90—90 and 92—92 in sympathy with first and second hinges 32 and 34, thereby permitting support structure 22, collapsible crib structure 74, and rigid floor member 88 to fold together in the direction of the arrows 100 and 102 in FIG. 2. Referring to FIG. 5, there is shown support structure 22, without the collapsible crib structure 74, folded together in the manner described. When collapsible support structure 22 and collapsible crib structure 74 are so folded, rigid floor member 88 forms a valise structure around support structure 22 and collapsible crib structure 74 as shown in FIG. 3. A conventional zipper 104 disposed about the perimeter of rigid floor member 88 is closeable in the manner a conventional valise would be closed, as shown in FIG. 3, providing a compact carrying case completely enclosing the collapsible crib structure and thereby protecting the crib structure from wear and tear and soiling while in transit. Handles 106 are provided for valise-like carrying capability.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A portable collapsible crib, comprising:

a rigid frame that is separable generally at the midpoints of a pair of opposing sides thereof into a first frame half and a second frame half;

rotatable hinging means, coupling said first and second frame halves at said midpoints, hingingly operable about first axes for foldably collapsing said first and second frame halves one upon the other at said midpoints, defining a frame collapsing position, and rotatably operable about a pair of second axes that are perpendicular to said first axes for rigidly supporting said first and second frame halves in inflexible planar alignment, defining a frame inflexible position;

leg means, mounted to and rotatable about said frame concurrently with said rotatable hinging means, for elevating said frame to a predetermined height when rotated about and disposed downwardly from said frame, said rotatable hinging means being concurrently rotated into said frame inflexible position, said leg means being further rotatable about said frame into the area bounded by said frame, said rotatable hinging means being concurrently rotated into said frame collapsing position; and a collapsible crib structure mounted to and supported about the perimeter of said frame and disposed downwardly therefrom, having rigid floor means removably attached to said leg means at predetermined points below said rigid frame when said leg means are rotated about and disposed downwardly from said frame, and operable to receive said rigid frame, said leg means and said collapsible crib structure within the area bounded by the perimeter of said floor means when said leg means are rotated about said frame into the area bounded by said frame, said rotatable hinge means being concurrently rotated into said frame collapsing position, said rigid floor means being further operable to fold about and enclose said first and second frame halves in said frame collapsing position and said collapsible crib structure, forming a valise structure thereabout.

2. The portable collapsible crib of claim 1, wherein said rigid frame is rectangular in configuration.

3. The portable collapsible crib of claim 2, wherein said first frame half includes a rigid first U-member and said second frame half includes a rigid second U-member, said first and second U-members being of equal corresponding dimensions.

4. The portable collapsible crib of claim 3, wherein said first U-member includes a first U-tube and said second U-member includes a second U-tube.

5. The portable collapsible crib of claim 4, wherein said rotatable hinging means includes a rigid first top rail tube and a rigid second top rail tube, said first and second top rail tubes each being separably hinged at the midpoints thereof, and sized and disposed in parallel relationship such that said first and second top rail tubes slidably receive said first U-bar at corresponding ends of said first and second top rail tubes, and said top rail tubes slidably receive said second U-bar at the corresponding opposite ends of said first and second top rail tubes, said first and second top rail tubes remaining rotatable about the received portions of said first and second U-bars, being thereby operable to rotate said hinges at said midpoints of said first and second top rails between said frame collapsing and said frame inflexible positions.

6. The portable collapsible crib of claim 5, wherein said leg means includes a first pair of legs attached to said rigid first top rail tube and disposed on either side of said midpoint of said first top rail tube in planar relationship with said hinge at said midpoint of said first top rail tube, and a second pair of legs attached to said rigid second top rail tube and disposed on either side of said midpoint of said first top rail tube in planar relationship with said hinge at said midpoint of said first top rail tube.

7. The portable collapsible crib of claim 6, wherein said legs means further includes a first pair of bottom support means pivotally attached to the distal ends of said first pair of legs and removably attachable at the other ends thereof to said rigid floor means when in said frame inflexible position.

8. The portable collapsible crib of claim 6, wherein said legs means further includes a second pair of bottom support means pivotally attached to the distal ends of said second pair of legs and removably attachable at the other ends thereof to said rigid floor means when in said frame inflexible position.

9. The collapsible crib of claim 1 wherein said valise (means) structure includes zipper means fixably attached to the perimeter of said floor means for securely enclosing said solid frame, said leg means and said collapsible crib structure in said frame collapsing position.

10. The collapsible crib of claim 1 wherein said collapsible crib structure includes padding means fixably attached to said rotatable hinging means and rotatable therewith between said frame collapsing and frame inflexible positions and operable thereby to substantially surround said rotatable hinging means with said padding means when said rotatable hinging means is rotated to said frame inflexible position.

11. A portable collapsible frame for supporting a collapsible crib structure, comprising:

a rigid frame that is separable generally at the midpoints of a pair of opposing sides thereof into a first frame half and a second frame half;

rotatable hinging means, coupling said first and second frame halves at said midpoints, hingingly operable about first axes for foldably collapsing said first and second frame halves one upon the other at said midpoints, defining a frame collapsing position, and rotatably operable about a pair of second axes that are perpendicular to said first axes for rigidly supporting said first and second frame halves in inflexible planar alignment, defining a frame inflexible position,;

leg means, mounted to and rotatable about said frame concurrently with said rotatable hinging means, for elevating said frame to a predetermined height when rotated about and disposed downwardly from said frame, said rotatable hinging means being concurrently rotated into said frame inflexible position, said leg means being further rotatable about said frame into the area bounded by said frame, said rotatable hinging means being concurrently rotated into said frame collapsing position; and rigid floor means removably attached to said leg means at predetermined points below said rigid frame when said leg means are rotated about and disposed downwardly from said frame, and operable to receive said rigid frame and said leg means within the area bounded by the perimeter of said floor means when said leg means are rotated about said frame into the area bounded by said frame, said rotatable hinge means being concurrently rotated into said frame collapsing position; said rigid floor means being further operable to foldably collapse about and enclose said first and second frame halves in said frame collapsing position, forming a valise structure.

12. A portable collapsible frame for supporting a collapsible crib structure, comprising:

a rigid frame that is separable generally at the midpoints of a pair of opposing sides thereof into a first frame half and a second frame half,;

rotatable hinging means, coupling said first and second frame halves at said midpoints, hingingly operable about first axes for foldably collapsing said first and second frame halves one upon the other at said midpoints, defining a frame collapsing position, and rotatably operable about a pair of second axes that are perpendicular to said first axes for rigidly supporting said first and second frame halves in inflexible planar alignment, defining a frame inflexible position; and leg means, mounted to and rotatable about said frame concurrently with said rotatable hinging means, for elevating said frame to a predetermined height when rotated about and disposed downwardly from said frame, said rotatable hinging means being concurrently rotated into said frame inflexible position, said leg means being further rotatable about said frame into the area bounded by said frame, said rotatable hinging means being concurrently rotated into said frame collapsing position.

* * * * *